US008761589B2

(12) United States Patent
Roetker et al.

(10) Patent No.: US 8,761,589 B2
(45) Date of Patent: Jun. 24, 2014

(54) HEATED WATER ENERGY STORAGE SYSTEM

(75) Inventors: John Joseph Roetker, Louisville, KY (US); Jonathan Nelson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 87 days.

(21) Appl. No.: 13/368,462

(22) Filed: Feb. 8, 2012

(65) Prior Publication Data

US 2013/0202277 A1 Aug. 8, 2013

(51) Int. Cl.

| | |
|---|---|
| ***A47J 27/00*** | (2006.01) |
| ***A47J 31/54*** | (2006.01) |
| ***F24H 1/18*** | (2006.01) |

(52) U.S. Cl.

USPC ..... 392/441

(58) Field of Classification Search

CPC ..... F24H 1/18; F24H 9/2021; G05D 23/1909; G05D 23/27522; G05D 23/27541; H05B 1/0283

USPC ..... 392/441, 447, 451, 463–464; 219/481, 219/494

See application file for complete search history.

(56) References Cited

U.S. PATENT DOCUMENTS

| | | | | |
|---|---|---|---|---|
| 3,422,248 | A | 1/1969 | Beaulieu et al. | |
| 4,713,525 | A * | 12/1987 | Eastep | 392/465 |
| 5,367,602 | A * | 11/1994 | Stewart | 392/308 |
| 2010/0179705 | A1 | 7/2010 | Flohr | |

* cited by examiner

*Primary Examiner* — Dana Ross
*Assistant Examiner* — Lindsey C Teaters
(74) *Attorney, Agent, or Firm* — Dority & Manning, P.A.

(57) ABSTRACT

A water heating storage system and method for controlling a water heating storage system for energy storage is provided. A water heating storage system may be in communication with a power generation utility to control and maintain temperatures within a storage tank in order to maximize energy storage and minimize energy usage.

20 Claims, 5 Drawing Sheets

HEATED WATER ENERGY STORAGE SYSTEM

FIELD OF THE INVENTION

The subject matter of the present invention generally relates to storing energy and more particularly to a system and method of storing energy in a water heater energy storage system.

BACKGROUND OF THE INVENTION

Water heater storage tanks are used for storing and supplying hot water to residential and commercial properties. A typical residential water heater holds about fifty gallons (190 liters) of water inside a steel reservoir tank. A thermostat is used to control the temperature of the water inside the tank. Many water heaters permit a consumer to set the thermostat to a temperature between 90 and 150 degrees Fahrenheit (F) (32 to 65 degrees Celsius (C)). To prevent scalding and to save energy, consumers may set the thermostat to heat the reservoir water to a temperature in a range between 120.0 degrees F. to 140.0 degrees F. (about forty-nine degrees C. to sixty degrees C.).

A water heater typically delivers hot water according to the thermostat temperature setting. As a consumer draws water from the water heater, the water temperature in the water heater usually drops due to cooler supply water displacing the heated water in the storage tank. As the thermostat senses that the temperature of the water inside the tank drops below thermostat's set point, power is sent to the electric resistance heating element (or a burner in a gas water heater). The electric elements then draw energy to heat the water inside the tank to a preset temperature level.

Water heating may constitute 10-15% of household energy usage, totaling 7 to 14 kWh per day. In some locations of the United States and globally, the cost for electrical energy to heat water can depend upon the time of day, day of the week and season of the year. In areas of the United States where energy is at a premium, utility companies often divide their time of use rates into off-peak and on-peak energy demand periods with a significant rate difference between the periods. For example, energy used during off-peak hours may cost the consumer in United States dollars around 5 cents to 6 cents per kilowatt hour (kWh), while on-peak period energy may cost anywhere from 20 cents per kWh to $1.20 or more per kWh.

Household energy demands typically correspond to on-peak energy periods where the cost to produce the energy may be at a maximum for the utility company and the cost to use the energy may be at a maximum for the customer. Various conventional energy saving techniques have been utilized in an attempt to minimize the cost of energy to both the utility company and the consumer.

One approach may be to use a programmable timer to turn off the entire water heater or the lower element. For example, a clock timer could be used to provide planned heating periods during known off peak periods of the day. While this approach is possible, adapting to period variation in the rate schedule and emergency load shedding request signals from the utility are not accommodated.

Another approach is to increase the storage size of the tank and/or increasing the set temperature of the tank in combination with use of a thermostatic mixing valve at the hot water outlet. Hot water capacity may be increased, but it does not alter the energy consumption pattern of the water heating system. A lower heating element may also need to be disengaged in order to avoid consumption during "on peak" energy rate hot water usage.

Set point alteration is another means to reduce heating events during on peak water usage. While this may produce a similar outcome as disengagement of the heating elements, it requires a substantially different control mechanism for regulation and limiting of the tank temperature and cannot be easily retrofitted to an existing water heating system.

Alternatively, the entire water heater may be shut off during on peak energy periods. This could result in the consumer running out of hot water during peak hours and left to wait until off peak hours to resume heating the entire stored water volume of the tank, meeting demand. This approach requires consumer behavior change or purchase and installation of a larger storage tank size to bridge the peak hour water usage. This results in an investment requirement from the consumer and presumes the availability of space to install a larger tank. Commonly, space limitations and/or standardization of heater sizes may prevent installation of a water heater large enough to meet the storage needed to bridge the peak hours.

Accordingly, a need exists for providing an energy storage method and apparatus that allows for storage during low demand energy production times. In addition, it would be advantageous to have communications between the utility provider and the energy storage system in order to improve overall efficiency.

BRIEF DESCRIPTION OF THE INVENTION

Aspects and advantages of the invention will be set forth in part in the following description, or may be obvious from the description, or may be learned through practice of the invention.

A water heater energy storage system including a storage tank that stores water, at least one heating element disposed with the storage tank, a thermostatic controller that senses and regulates tank water temperature, a signal communication device in communication with a utility that sends and receives system information, and a controller configured to regulate the system based on communications between the signal communication device and the utility.

A method for controlling a water heating energy storage system including establishing communications between a utility and a water heating energy storage tank, transmitting a tank status signal to the utility, receiving a control signal from the utility, and operating the water heating energy storage system based on the control signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
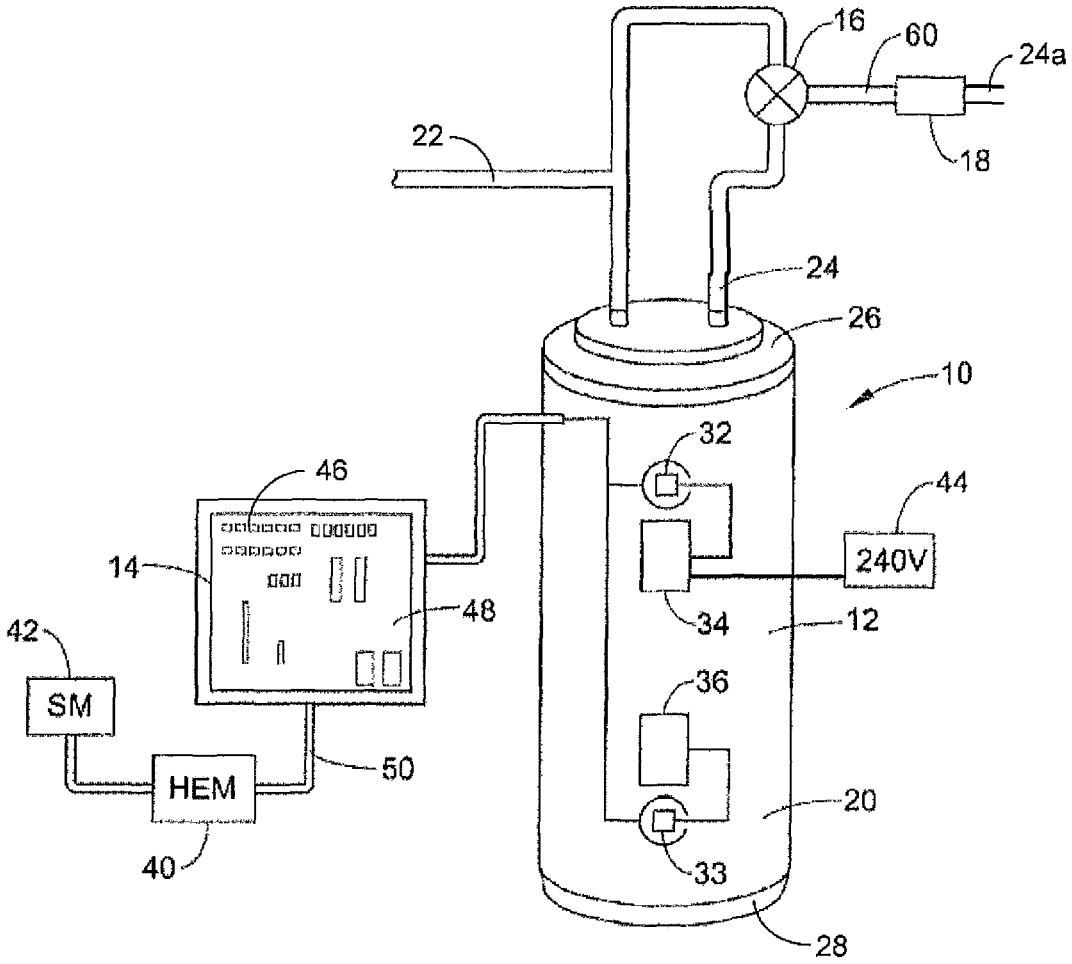
FIG. 1 provides a diagram of an exemplary embodiment of a water heating storage system of the present invention.

The present invention relates to a water heating storage system and method for controlling a water heating storage system for energy storage. The water heating storage system may be in communication with a power generation utility to control and maintain temperatures within a storage tank in order to maximize energy storage and minimize energy usage.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to FIG. 1, a water heating control and storage system 10 in accordance with an exemplary embodiment of the present disclosure is illustrated. The water heater system 10 includes a water heater 12, a control panel 14, a mixing valve 16, and a cutoff valve 18.

The water heater 12 has a heating element 32 and an inner tank to store heated water. The water heater includes a shell 20 that surrounds the inner tank, a "cold inlet" pipe 22, a "hot outlet" pipe 24, and a cover 26. Insulation may be provided between shell 20 and the inner tank to reduce heat transfer. For typical domestic household use, the tank is preferably 80-gallon capacity or more. The "cold inlet" pipe 22 delivers water to the water heater 12 at a temperature less than about 120 degrees F. (about 49 degrees C.), typically 40 to 80 degrees F. (4 to 27 degrees C.). The "hot outlet" pipe 24 conventionally delivers water away from the water heater 12 at a temperature of about 120 degrees F. (about 49 degrees C.). The cover 26 and base 28 seals the shell 20 by providing an enclosure for the tank, insulation and wiring system.

The water heater 12 further includes heating elements 32, 33, thermostatic controllers 34, 36, and a power source 44 that may be coupled to the thermostatic controller 34 or heating element 32 to provide power to activate the heating element 32. Power source 44 may be a typical 240V input or any other voltage level. While only two heating elements are illustrated in FIG. 1, additional heating elements and corresponding thermostats may be included in the system. Heating elements 32, 33 may be electric resistance heating elements and/or heat pumps and/or a combination thereof. For example, a water heater system 10 may include two electric resistance heating elements and a heat pump. If the water heater 12 includes a plurality of heating elements, one heating element may be positioned on the upper portion of the storage tank and the other heating element may be positioned on the lower portion of the storage tank, however any configuration may be used. Thermostatic controllers 34, 36 may be thermo-mechanic devices that act as switches, mechanically responding to temperature changes to actuate the energy circuit controlling heating elements 32, 33, respectively. Alternatively, the thermostatic controllers may also sense water temperature and regulate the heating elements based on the sensed temperature. The thermostatic controllers 34, 36 include thermal limiting devices to regulate and limit the water temperature. If a plurality of heating elements is utilized, the thermostatically controlled heating elements may operate in any time or duration configuration such as simultaneously, sequentially or alternatively. For example, when two electric resistive elements are used in combination with a heat pump, the resistive elements may operate simultaneously or alternatively and the heat pump may operate when the resistive elements are deactivated.

Various temperature sensing methods and configurations may be used to determine the temperature of the water in the storage tank. A single temperature sensor may be used or a plurality of temperature sensors may be disposed at various locations in the storage tank and used in combination with thermostats. Alternatively, a single device, a thermostatic controller, may function as both a thermostat and a temperature sensor. When the temperature sensors are separate devices, two or more sensors may be placed in a vertical array to provide measurements corresponding to the water temperature gradient in the tank to communicate to the utility how much energy storage capacity is available.

The water heater system 10 may further include a thermostatic mixing valve 16 connected to the "cold inlet" pipe 22 and the "hot outlet" pipe 24. The mixing valve 16 may be connected to blend water from the cold water supply line 22 with the hot water drawn from the storage tank to temper the water delivered via tempered water outlet **24*a*** to the user at a desired temperature for residential or commercial use. For example, the mixing valve may combine cold water having a temperature of about 40-80 degrees F. and hot water from the storage tank to achieve an output water temperature of about 120 degrees F.

A cutoff valve 18 may be provided as a safety backup to the mixing valve 16. For example, the cutoff valve 18 may be a thermostat-controlled safety device that automatically closes if the water in service pipe 60 reaches a predetermined high temperature, such as between about 120 to 160 degrees F.

Water heater 12 may be connected to a "smart" meter 42 and home energy manager (HEM) 40 through control panel 14 and signal line 50. The control panel 14 may include a demand response controller 48 and a user interface 46.

User interface 46 may have various configurations and input components that may allow for the selective activation, adjustment or control of water heater system 10. One or more of a variety of electrical, mechanical or electro-mechanical input devices including rotary dials, push buttons, and touch pads may also be used singularly or in combination with a touch screen input device component. The user interface 46 may include a display component, such as a digital or analog display device designed to provide operational feedback to a user. For example, the user display 46 may display the current temperature set point of the water heater 12. The user may then select to modify a desired set point. Alternatively or in addition to setting a temperature, the user may select when energy storage parameters should occur. The parameters may include time, temperature, usage, desired usage depending on rates, etc.

Demand response controller 48 may be in communication with a power generation utility. Communication between the water heater system 10 and the utility may be one-way or two-way communications. In other words, demand response control 48 may receive communications from the utility, transfer communications to the utility or both. For example, demand response control 48 may transfer information regarding the storage tank such as a current set point temperature of the water heater system 10, the energy capacity remaining at the current set point temperature and/or the energy capacity remaining after the current temperature set point is increased to a higher temperature. The demand response control 48 may also receive a signal from the utility to override the current operating mode. In addition, the demand response controller 48 may be configured to receive and process a signal indicative of a current state of a utility or energy provider. Communication between the demand response controller 48 and the utility may be through any means of communication such as a hard wire or wireless connection.

Smart meter 42 may be an advanced utility meter that measures utility usage and provides the user with information regarding energy consumption, such as real time utility pricing, up-to-date utility costs, current kilowatt usage, etc. The smart meter 42 may be in one-way or two-way communication with the utility company to provide system monitoring information such as usage, peak or off-peak rates, billing information, etc. A user may program smart meter 42 to communicate at a specific interval or smart meter 42 may be pre-programmed to automatically communicate with the utility within a predetermined time interval. In addition, smart meter 42 may be integral with control panel 14 or it may be a separate device. A user may utilize information communicated by smart meter 42 to determine parameters which are then considered when the demand response controller 48 is in communication with the utility provider.

A residential or commercial property may also include a home energy manager (HEM) 40 which may allow a user to manage all utility uses from a single interface to minimize energy use and cost while maintaining maximum energy functionality. For example, a user inputs desired energy usage information and parameters and the HEM controls all appliances and devices in communication with the HEM accordingly. The HEM 40 may be connected to a singular device or a plurality of devices and could operate based on default or user defined parameters.

Figure 2:
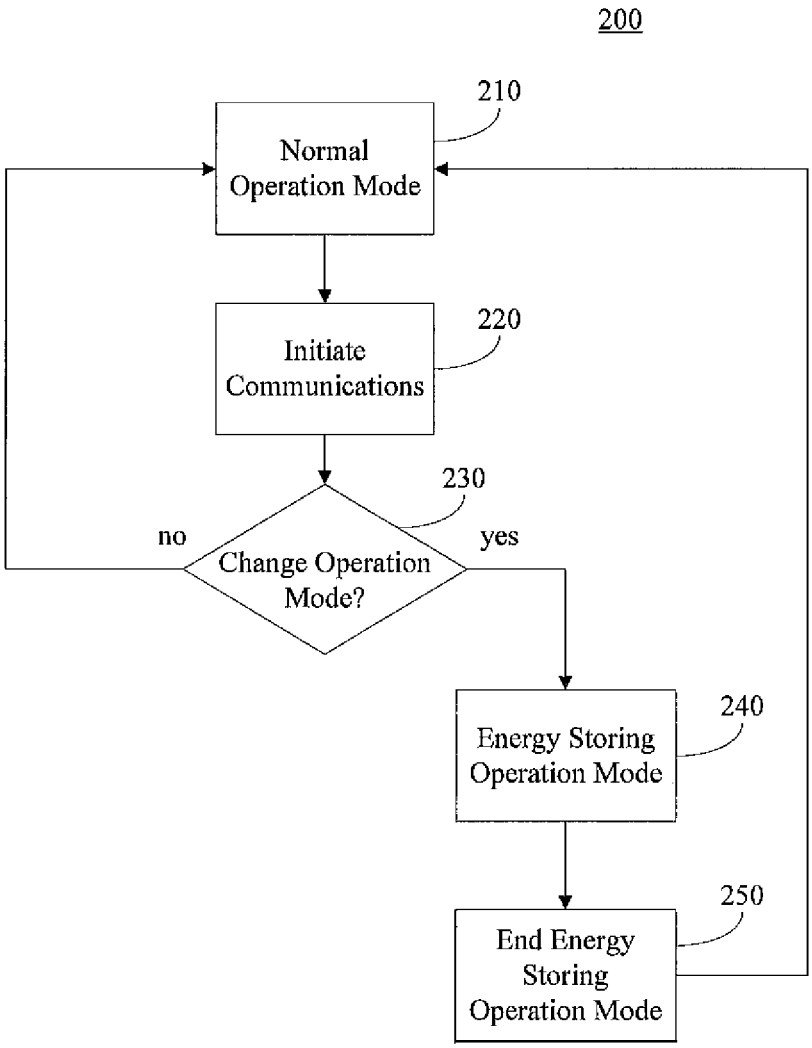
FIG. 2 provides a flow chart for a method for storing energy in a water heating system according to an exemplary embodiment of the present disclosure.

With reference to FIG. 2, flowchart 200 may describe how water heater system 10 is controlled between two different operation modes. At step 210, the water heater system 10 may be operating in a normal operation mode using normal operational temperatures. While the normal operation mode is described initially, the water heater system 10 may alternatively be in energy storing operation mode. When the water heater system 10 is in the normal operation mode, communications may be initiated in step 220 to change the operation mode of the water heater system 10. For example, if the water heater is in normal operation mode, the communication may inquire about switching into energy storing operation mode or if the water heater is in energy storing operation mode, the communication may inquire about switching into normal operation mode.

The communications in step 220 may be a signal initiated by a utility provider to the water heater system 10 or the water heater system 10 may initiate the communications by sending a signal to the utility provider. The signal may be initiated in various ways and at various times, such as an automated signal performed at predetermined intervals or the signal may be initiated by an offsite user at a utility facility. These examples in no way limit the ways or times the signal may be initiated. The signal may request that the water heater system 10 enter an energy storage mode, which may allow the water heater system 10 to store surplus energy in the form of heated water.

When the communication includes information regarding a change in operation mode, it may be determined in step 230 if the operation of the water heater system 10 may be changed. This determination may be made at the utility, at the water heater system and/or based on user inputs. The water heater system 10 may determine the current temperature set point in which the storage tank is currently operating; what, if any, energy storage capacity remains at the current temperature set point; and/or what, if any, energy storage capacity would remain if the current temperature set point was increased to a higher temperature. For example, if a user selects a normal operating temperature in the range of 120-140 degrees F., the utility may inquire as to the current temperature of the water in the storage tank and any available energy storage capacity. Various parameters may be considered when determining whether a change in operation should occur such as current temperature set points, energy production costs and loads including seasonal parameters, weekend vs. weekday usage, and on-peak and off-peak usage, etc. Alternatively, or in addition to the various parameters, energy supply sources may also be considered. For example, typical utility production may be monitored to determine any deviations from the anticipated load, as well as monitoring for energy production using alternative energy means such as wind and solar inputs. When alternative energy means are coupled to the power grid they may produce surplus energy spikes based on energy generation. Energy production is independent of on-peak and off-peak generation and may fluctuate with alternative energy sources based on availability of the renewable sources (e.g. wind or sun).

The determination may include possible temperature adjustments such as increasing the temperature set point, decreasing the temperature set point or maintaining the current set point. For example, if the current operating temperature of the water tank is in the range of 120-140 degrees F., it may be determined to increase the temperature set point to a higher temperature, not to exceed a maximum energy storage temperature, such as 160 degrees F. If the current operating temperature is around 160 degree F., it may be determined not to increase the temperature and maintain the current temperature set point. Alternatively, at any temperature, a decision may be made to decrease the current temperature set point.

If it is determined that there should not be a change in operation mode, the water heater system 10 continues to operate in the current operation mode. However, if it is determined that a change in operation mode may occur, there is a control signal communicated which instructs the water heater system 10 to change operating modes. This control signal may be sent to the control panel 14 from the utility provider or the HEM 40. The specifics of how the water heater system 10 changes modes will be described below. At step 240, the water heater system 10 enters the energy storing mode after receiving the control signal.

During the energy storing mode, there may be numerous energy storing settings. For example, an energy storing setting may correspond to a different factor such as a temperature set point, an energy rate, a consumption time, or energy production time.

An energy storing mode may be a temporary mode and the water heater system 10 may revert back to normal operation mode after receiving a signal identifying the end of an energy storing operation mode in step 250. This signal may be a signal sent after a predetermined time or it may be sent based on other parameters such as a temperature set point, an energy rate, a consumption time, or energy production time.

Figure 3:
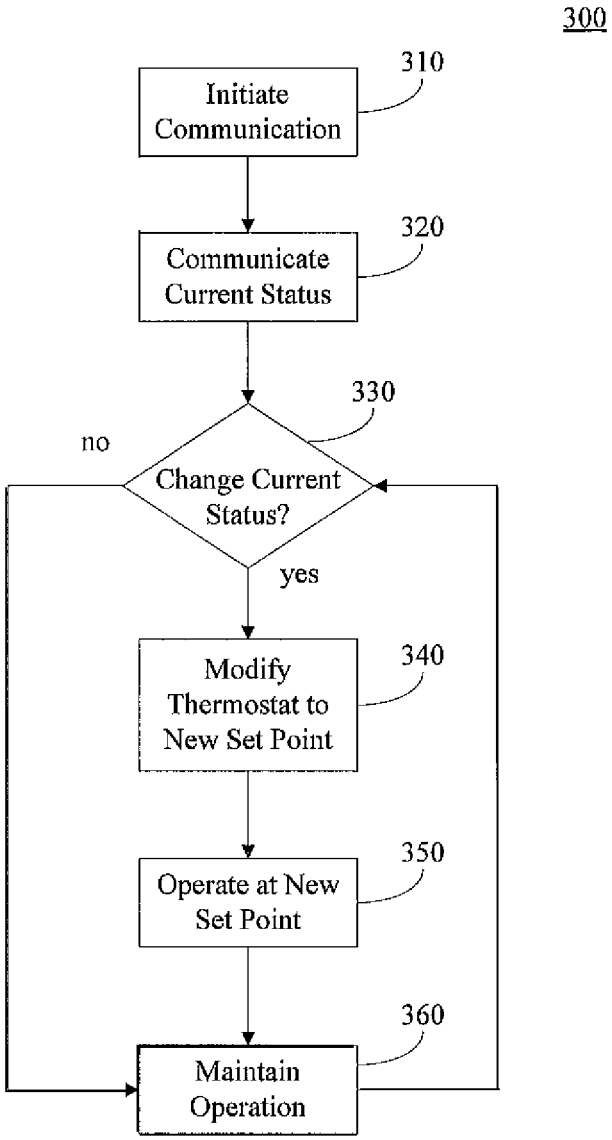
FIG. 3 provides a flow chart for a method for storing energy in a water heating system according to an exemplary embodiment of the present disclosure.

With reference to FIG. 3, method 300 may illustrate how the water heater system 10 changes modes. After communication is initiated in step 310, the water heater system 10 may communicate the current status in step 320. The water heater system 10 may determine the current temperature set point in which the storage tank is currently operating; what, if any, energy storage capacity remains at the current temperature set point; and/or what, if any, energy storage capacity would remain if the current temperature set point was increased to a higher temperature. For example, if a user selects a normal operating temperature in the range of 120-140 degrees F., the utility may inquire as to the current temperature of the water in the storage tank and available energy storage capacity. This information may be communicated to the utility or to the HEM 40.

In step 330, a determination may be made whether to change the current operation mode status. This determination may be made by the utility, the water heater system 10 and/or based on user inputs. The water heater system 10 may determine the current temperature set point in which the storage tank is currently operating; what, if any, energy storage capacity remains at the current temperature set point; and/or what, if any, energy storage capacity would remain if the current temperature set point was increased to a higher temperature. For example, if a user selects a normal operating temperature in the range of 120-140 degrees F., the utility may inquire as to the current temperature of the water in the storage tank and any available energy storage capacity. Various parameters may be considered when determining whether a change in operation should occur such as current temperature set points, energy production costs and loads including seasonal parameters, weekend vs. weekday usage, and on-peak and off-peak usage, etc. Alternatively, or in addition to the various parameters, energy supply sources may also be considered. For example, typical utility production may be monitored to determine any deviations from the anticipated load, as well as monitoring for energy production using alternative energy means such as wind and solar inputs. When alternative energy means are coupled to the power grid they may produce surplus energy spikes based on energy generation. Energy production is independent of on-peak and off-peak generation and may fluctuate with alternative energy sources based on availability of the renewable sources (e.g. wind or sun).

If it is determined that the current operation mode should not change, then the water heater system 10 continues to maintain the current operation in step 360. However, if it is determined that the water heater system 10 may change operation status, the various parameters may be considered and the set point of thermostatic controller 34 and/or 36 may be modified such as an increase or decrease in heating element temperature. After the thermostatic controller modifies the set point, the water heater system 10 may operate at the new set point in step 350 until the new set point is reached. The new set point is maintained in step 360 until a control signal is received to indicate another change in operation mode in step 330.

Figure 4:
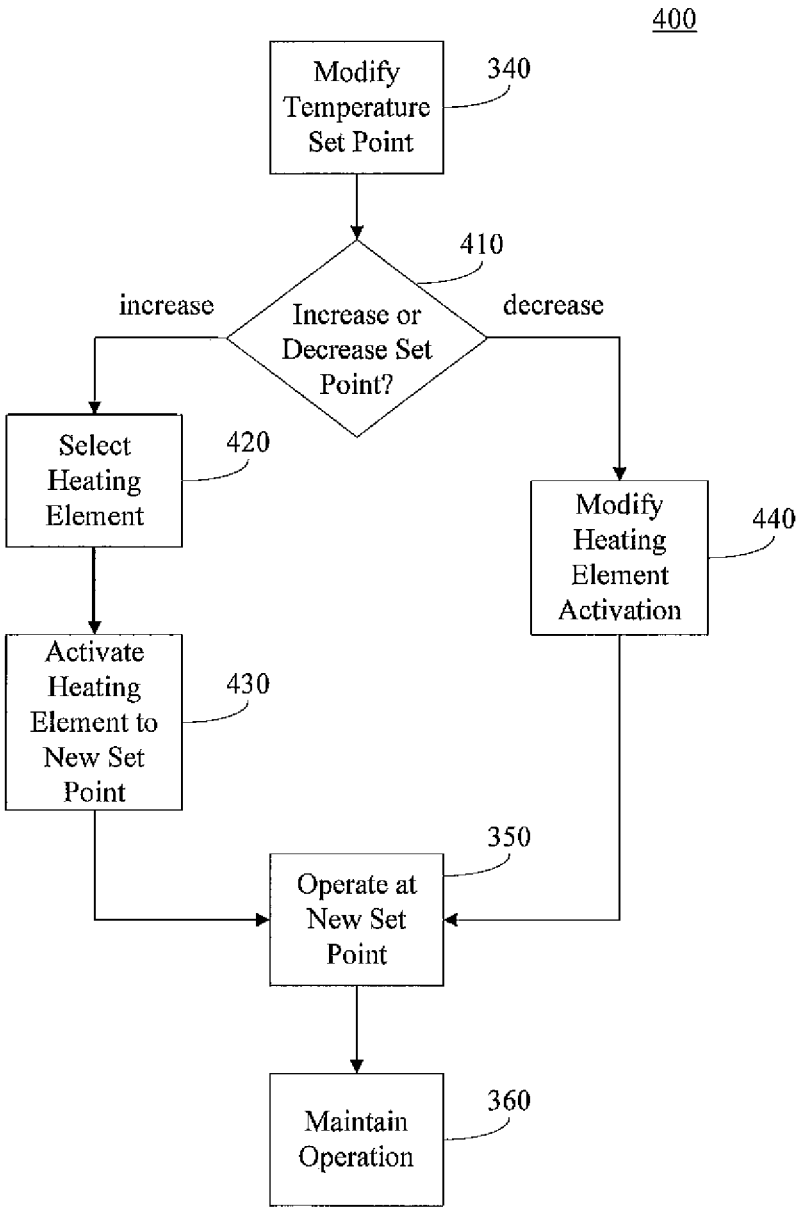
FIG. 4 provides a flow chart for a method for storing energy in a water heating system according to an exemplary embodiment of the present disclosure.

FIG. 4 illustrates the method 400 of modifying the temperature set point based on a selected operation mode. In step 340, a signal may be received to indicate that the thermostatic controller may modify the set point based on an operation mode. It may be determined whether the set point may be increased or decreased in step 410.

If it is determined that the temperature set point may be increased, a heating element may be selected in step 420. A single heating element 32 may be selected or a plurality of heating elements, for example 32, 33 may be selected. This selection may be made by the utility, by the water heater system 10 and/or based on user inputs. More particularly, in a water heating system 10 that includes a heat pump and a resistive electric element, the utility may select the heat pump as the heating element and/or the resistive electric element. For example, resistive electric elements heat water more quickly, but consume more power in a shorter period of time. Using a heat pump as the heating element may heat the water more efficiently but will take a longer time to reach the new temperature. These parameters and the user defined parameters may be considered and a heating element selected accordingly. After at least one heating element is selected, the heating element(s) may be activated based on the new set point in step 430.

If it is determined that the temperature set point may be decreased, the set point and activation of the heating element is modified in step 440. This may include decreasing the temperature set point to a lower temperature or it may also be completely deactivating the heating element until a temperature set point is reached. Deactivation of the heating element 32, 33 may occur in various ways. For example, heating element 32, 33 may automatically deactivate after a predetermined time interval following activation of the heater or the water heating storage system 10 may monitor the temperature of the water in the water heater and determine when to deactivate the heater based on temperature and/or time measurements. In addition, a current system status may be requested so a determination may be made to deactivate the heater.

After the heating element 32 is deactivated, the water heater storage system 10 may allow the stored energy to be depleted before accepting additional communication from the utility or the water heater storage system may remain in constant communication, allowing the heating element to be activated by the utility at any time. Further, the water heater storage system 10 may activate the heating element based on predetermined user inputs.

The heating element may be activated or modified to a new set point temperature in a single step or even or random increments over a predetermined time to maximize energy recovery and minimize energy use. For example, an even increment or decrement may be 5 degrees F., where each increment or decrement occurred every 30 minutes.

After the heating element is activated in step 430 or modified in step 440, the water heater system 10 operates at the new set point at step 350 and this new set point is maintained 360 until it is determined that a change in operation mode may take place.

Figure 5:
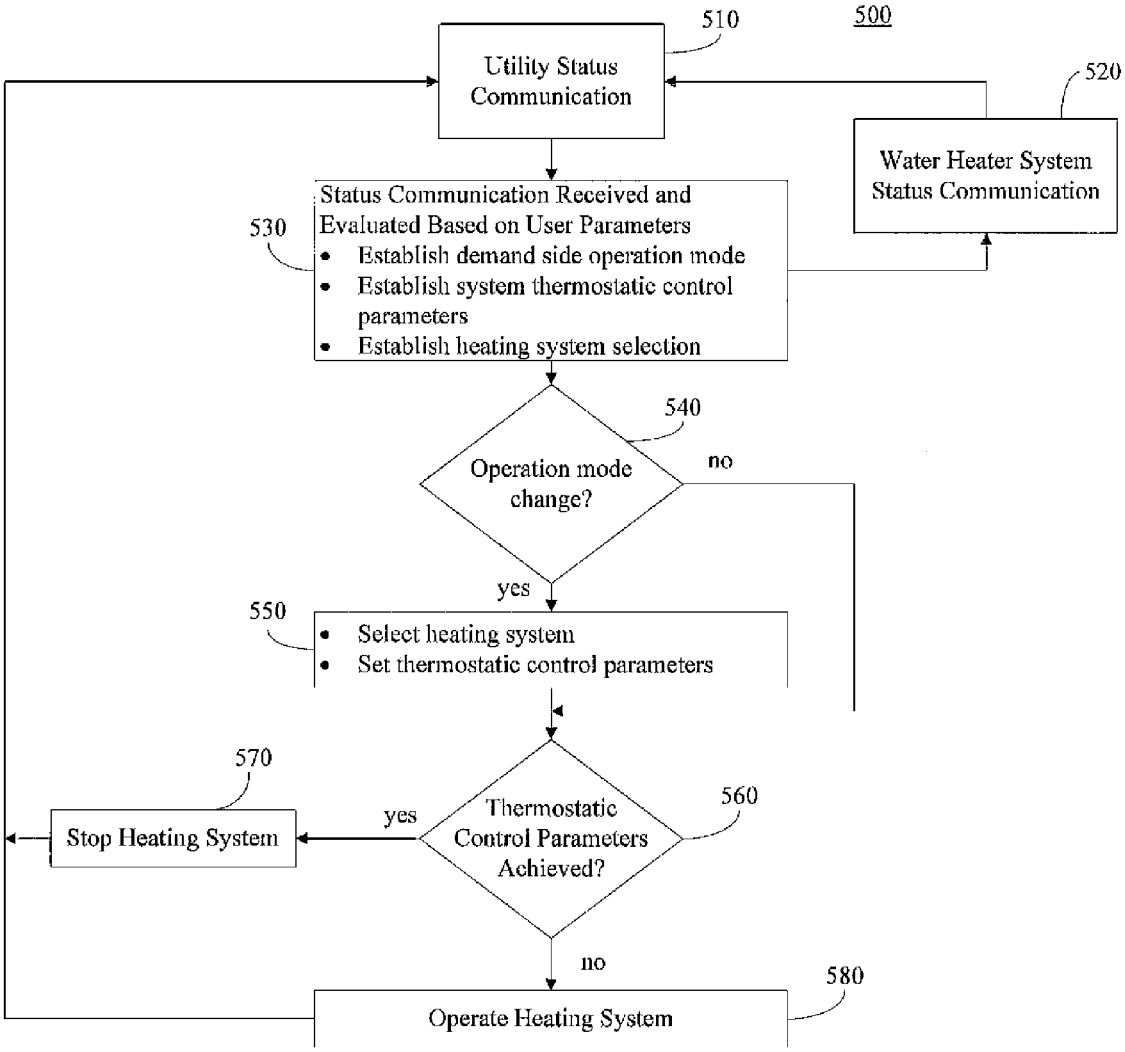
FIG. 5 provides a flow chart for a method for storing energy in a water heating system according to an exemplary embodiment of the present disclosure.

FIG. 5 illustrates an exemplary embodiment of a system 500 for controlling a water heating energy storage system. Utility status communications are illustrated at 510 and may be initiated by the utility or it may be in response to water heater system status communication 520. These communications may be evaluated based on user parameters and used to establish a demand side operation mode, thermostatic control parameters and a heating system selection in 530. In 540, a determination is made whether to change operation modes based on 530. If it is determined that an operation mode is to be changed, the heating system is selected and the thermostatic control parameters are set in 550. After 550 or if it is determined that the operation mode is not to be changed, the system is monitored to determine whether the thermostatic control parameters have been achieved in 560.

If the thermostatic control parameters have been achieved then the heating system is stopped in 570 and returns to the utility status communication in 510. If the thermostatic control parameters have not been achieved, then the heating system continues to operate in 580 before returning to the utility status communication in 510.

Accordingly, the present invention allows for a utility provider, such as a power generation utility, to be in remote communication with a water heating storage system in a residential or commercial setting to maximize the efficiency of the system and minimize the cost of energy production and consumption. The utility provider may selectively control the heater in the system based on a selected operation mode to achieve an energy storing operation mode or normal operation mode. In addition, the utility provider may act independently or in conjunction with the water heating storage system. The utility provider may identify desired temperatures to operate the system or a user may identify parameters the utility provider may consider when determining operating controls. For example, the utility provider may communicate with the water heating storage system to enter an energy storage mode during an off-peak energy production period to provide energy storage that may be used during peak hours to minimize additional energy production and cost during that time.

While the aforementioned discussion is drawn to a single water heating control and storage system, one of ordinary skill would recognize that a utility provider may be in communication with a plurality of water heating control systems in the same locations or different locations. In addition, one of ordinary skill would recognize that home energy manager 40 and/or demand response controller 48 may include a memory and microprocessor, CPU or the like, such as a general or special purpose microprocessor operable to execute programming instructions or micro-control code associated with the water heater storage system. The memory may represent random access memory such as DRAM, or read only memory such as ROM or FLASH. In one embodiment, the processor executes programming instructions stored in memory. The memory may be a separate component from the processor or may be included onboard within the processor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater energy storage system, comprising:

a storage tank that stores water;

at least one heating element disposed within the storage tank;

a thermostatic controller that senses and regulates tank water temperature;

a signal communication device in communication with a utility that sends and receives system information; and a controller configured to regulate the system based on communications between the signal communication device and the utility;

wherein the communications between the signal communication device and the utility comprise:

a query received by the signal communication device from the utility, wherein the query requests information concerning one or more system characteristics of the water heater energy storage system;

a transmission sent to the utility by the signal communication device, wherein the transmission provides the requested information concerning the one or more system characteristics; and a command received by the signal communication device from the utility, wherein the command specifies a modified set point temperature for the tank water temperature.

2. The system, as in claim 1, wherein the thermostatic controller senses and regulates tank water temperature based on the modified set point temperature based on the communications.

3. The system, as in claim 1, wherein the at least one heating element includes a heat pump and a resistive element and the communications between the signal communication device and the utility specify whether the system should operate to heat the water using the heat pump or the resistive element.

4. The water heater energy storage system of claim 1, wherein the one or more system characteristics of the water heater energy storage system comprise an amount of energy storage available at the water heater energy storage system, and wherein the transmission specifies the amount of energy storage available at the water heater energy storage system.

5. The water heater energy storage system of claim 1, further comprising a meter device for relaying the communications between the signal communication device and the utility.

6. The water heater energy storage system of claim 1, further comprising a home energy manager for relaying the communications between the signal communication device and the utility.

7. The water heater energy storage system of claim 1, wherein the modified set point temperature is determined at the utility based on the information concerning the one or more system characteristics.

8. A method for controlling a water heating energy storage system, comprising the steps of:

establishing communications between a utility providing organization and a water heating energy storage tank;

receiving, by the water heating energy storage system, a query from the utility providing organization, wherein the query requests information concerning one or more system characteristics of the water heater energy storage system;

in response to the query, transmitting, by the water heating energy storage system, a tank status signal to the utility providing organization, wherein the tank status signal includes the requested information;

receiving, by the water heating energy storage system, a control signal from the utility providing organization, wherein the control signal specifies a modified set point temperature for the water heating energy storage tank; and operating the water heating energy storage system based on the modified set point temperature.

9. The method as in claim 8, wherein the modified set point temperature is maintained in the system until a second control signal is received from the utility providing organization.

10. The method as in claim 8, wherein the water heating energy storage system is operated to reach the modified set point temperature incrementally over a time interval by incrementally increasing the set point temperature over the time interval.

11. A method for operating a water heating system, the method comprising:

receiving, by the water heating system, a query from the electric power company requesting information describing the one or more system energy storage characteristics;

transmitting, by the water heating system to an electric power company, the information describing one or more system energy storage characteristics;

receiving, by the water heating system, a command from the electric power company, wherein the command specifies an elevate temperature set point; and in response to the command, modifying an operating set point of the water heating system to the elevated temperature set point.

12. The method of claim 11, wherein the one or more system energy storage characteristics comprises an amount of available energy storage capacity at a current temperature set point of the water heating system.

13. The method of claim 11, wherein the one or more system energy storage characteristics comprises a projected energy storage capacity at the elevated temperature set point, the elevated temperature set point being associated with a higher temperature than a current temperature set point of the water heating system.

14. The method of claim 11, wherein the one or more system energy storage characteristics comprises a water temperature gradient in a tank of the water heating system, the water temperature gradient in the tank having been measured using a vertical array of two or more sensors in the tank.

15. The method of claim 11, further comprising maintaining the elevated temperature set point until a predetermined period of time elapses.

16. The method of claim 11, further comprising:

maintaining the operating set point at the elevated temperature set point until a second command is received from the electric power company, wherein the second command instructs the water heating system to revert the operating set point to a normal temperature set point;

in response to receiving the second command, modifying the operating set point to the normal temperature set point.

17. The method of claim 16, wherein the electric power company sends the second command to the water heating system after a predetermined period of time has elapsed from sending the command specifying the elevated temperature set point.

18. The method of claim 16, wherein the electric power company sends the second command to the water heating system when the electric power company ceases to operate in an off-peak energy production period.

19. The method of claim 11, further comprising receiving, by the water heating system from a user, user input identifying one or more parameters that are available for the electric power company to analyze when determining operating controls for the water heating system.

20. The method of claim 11, wherein the command further specifies whether the water heating system should operate a heat pump component or an electric heating element component.

* * * * *